US005746970A

United States Patent [19]

Bergman et al.

[11] Patent Number: 5,746,970

[45] Date of Patent: May 5, 1998

[54] NOZZLE AND METHOD OF BLOWING HOT METAL

[75] Inventors: Dan Bergman, Luleå, Sweden; Takeo Inomoto, Chiba, Japan

[73] Assignee: Mefos, Stiftelsen För Metallurgisk Forskning, Lulea, Sweden

[21] Appl. No.: 678,389

[22] Filed: Jun. 28, 1996

Related U.S. Application Data

[63] Continuation-in-part of PCT/SE94/01260, Dec. 28, 1994.

[30] Foreign Application Priority Data

Dec. 30, 1993 [SE] Sweden ..... 9304369

[51] Int. Cl.[6] ..... C21C 5/32

[52] U.S. Cl. ..... 266/225; 266/265

[58] Field of Search ..... 266/225, 226, 266/265

[56] References Cited

U.S. PATENT DOCUMENTS

| | | | |
|---|---|---|---|
| 3,627,295 | 12/1971 | Doi et al. | 266/225 |
| 3,725,040 | 4/1973 | Jones | 266/225 |
| 4,993,691 | 2/1991 | Mousel et al. | 266/225 |
| 5,227,118 | 7/1993 | Bleser et al. | 266/225 |

FOREIGN PATENT DOCUMENTS

| | | |
|---|---|---|
| 1442939 | 5/1966 | France . |
| 2321853 | 11/1973 | Germany . |
| 0213010 | 5/1967 | Sweden . |
| 1198112 | 7/1970 | United Kingdom . |
| 9218819 | 10/1992 | WIPO . |

*Primary Examiner*—Scott Kastler

*Attorney, Agent, or Firm*—Nils H. Ljungman and Associates

[57] ABSTRACT

An annular nozzle for an oxygen lance, e.g. an oxygen lance for blowing steel in a converter, gives an annular hot spot on the liquid steel in the converter. When exiting the nozzle, the annular jet has disruptions that result in ambient atmosphere being sucked towards the center of the annular jet. Thus, a sub-pressure is prevented which would otherwise prevent the jet from diverging conically. In one embodiment, the nozzle can be switched during a blowing operation between forming a tight jet and forming a divergent jet.

5 Claims, 6 Drawing Sheets

NOZZLE AND METHOD OF BLOWING HOT METAL

CONTINUING APPLICATION DATA

This application is a Continuation-In-Part of International Patent Application No. PCT/SE94/01260 filed on Dec. 28, 1994 and published Jul. 6, 1995, which claims priority from Swedish Patent Application No. 9304369-3 filed on Dec. 30, 1993. International Patent Application No. PCT/SE94/01260 was pending as of the filing date of this application and designated the United States of America as a designated state.

BACKGROUND OF THE INVENTION

1. Field of the Invention

This invention relates to a supersonic annular nozzle and to a method of blowing hot metal.

2. Background Information

When refining a hot metal or an iron alloy, an oxidizing gas can be used. Typically the oxidizing gas used is oxygen, often "top-blown", or blown from above onto a liquid metal bath held in a metallurgical vessel. A blowing nozzle can be used to "blow metal", i.e., direct a jet of the oxidizing gas onto the metal bath. The impinging gas jet strikes the surface of the metal bath, causing a "hot spot" where metallurgical reactions take place. The use of the top-blown refining technique is commonly used in ferrous industry, and is being adapted in the nonferrous industry as well.

It is desirable the blowing nozzle provide a diverging annular jet of oxidizing gas. This creates a wide hot spot for more efficient metal making. The size and intensity of the hot spot should also be adjustable, to better suit the oxidizing needs of the particular batch of metal being refined.

It is therefore desirable to provide in a blowing nozzle a supersonic annular nozzle that can produce a diverging annular jet. Such a nozzle is known from GB-1198112. but it seems not to have been in practical use. A possible cause may be that there will be a subpressure in the middle of the annular jet which tends to hold the jet together so that there will not be the wide hot spot that is desired.

OBJECT OF THE INVENTION

It is an object of the invention to provide for a method and a nozzle that will permit a diverging annular jet. It is other objects to provide for an adjustable annular nozzle and to provide for an adjustable annular nozzle that can create both a tight jet and a diverging jet.

SUMMARY OF THE INVENTION

The present invention teaches that the above objects can be achieved by a single jet. The jet is partially blocked at the exit of the nozzle, causing the working gas to exit the nozzle as a plurality of individual gas streams. The gaps, or holes, between the gas streams allow ambient gas (typically the ambient air) to flow into the gaps and fill out the subpressure that would have otherwise occurred had the nozzle exit been unobstructed. As the individual gas streams proceed downstream from the nozzle exit, each individual gas stream will expand radially and circumferentially. The expansion reunites or coalesces the individual gas streams to re-form one common annular gas stream, allowing a solid annular ring of gas to strike the surface of the metal bath.

A central blocking body is located within a supersonic nozzle. The central blocking body forms an annular slot wherein the working gas must pass prior to exiting the nozzle. The slot is divided into two or more separate portions by obstructions located at the exit of the nozzle, thereby separating the gas exiting the nozzle into the separate individual gas streams discussed above. Placing the obstructions at the nozzle exit rather than upstream from the nozzle exit prevents the individual gas streams from reuniting or coalescing prior to exiting the nozzle. The slot obstructions can be formed by keys or axial lands located on the central blocking body. Alternatively, the slot obstructions may be formed by the outer body of the nozzle, or formed by a separate component piece attached to the central blocking body.

Further, the location of a central blocking body can be varied within the nozzle, to adjust the divergence of the resulting gas stream. The central blocking member can be fixedly attached to a rod that extends longitudinally through the top blowing nozzle. By moving the rod, the central blocking member can be moved upstream or downstream relative to the nozzle, changing the flow characteristics of the nozzle. Both a tight gas stream and a diverging gas stream could thus be produced from the same nozzle during various phases of the same blowing operation.

In addition, the rod could be realized as a hollow tube, in communication with a hollow passage contained in the central blocking body. Additional gas flow can be provided through the rod and central blocking body and be introduced at the exit of the nozzle. This additional gas flow will also fill out the subpressure located at the exit of the nozzle. The additional gas flow could be used alone or in conjunction with the separate stream portions to fill out the subpressure and assure divergent supersonic flow of the working gas from the nozzle. The rod could also be formed as a tube-formed rod for delivering pulverized material via the central blocking body to the metal bath during the refining process.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention will be described with reference to the accompanying drawings that show three annular nozzles in accordance with the invention. Three additional annular nozzles will also be shown in accordance with the invention.

DESCRIPTION OF THE PREFERRED EMBODIMENTS

Figure 1:
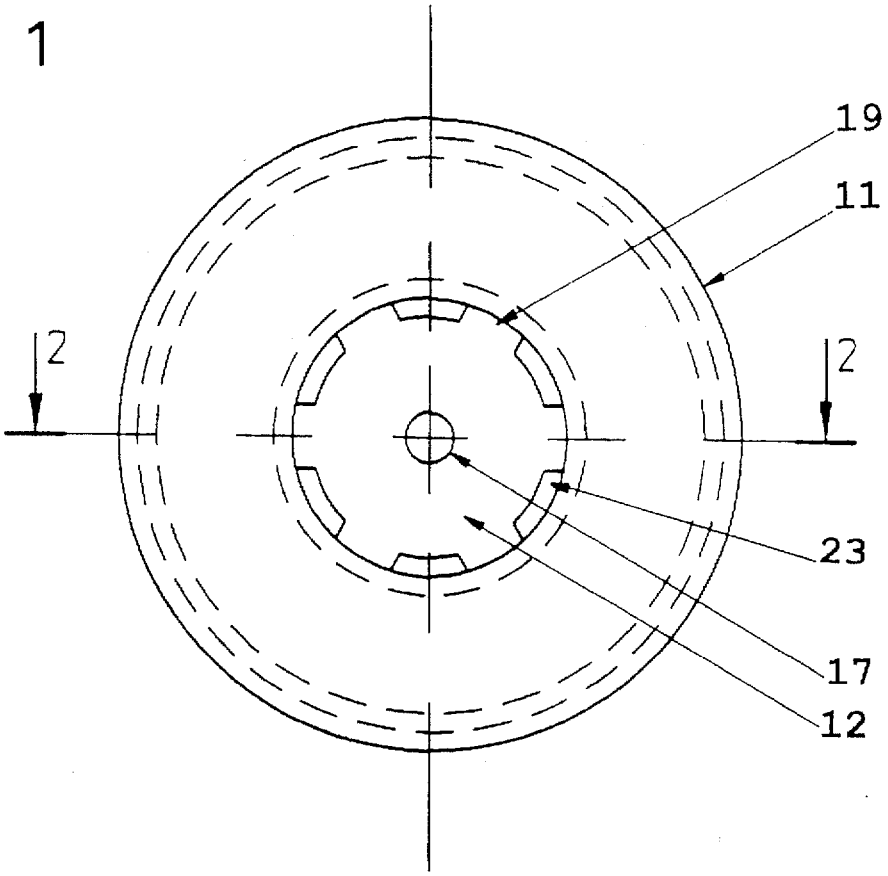
FIG. 1 is an end view of a top blowing nozzle and FIG. 2 is a section taken along the line 2—2 in FIG. 1.
Figure 2:
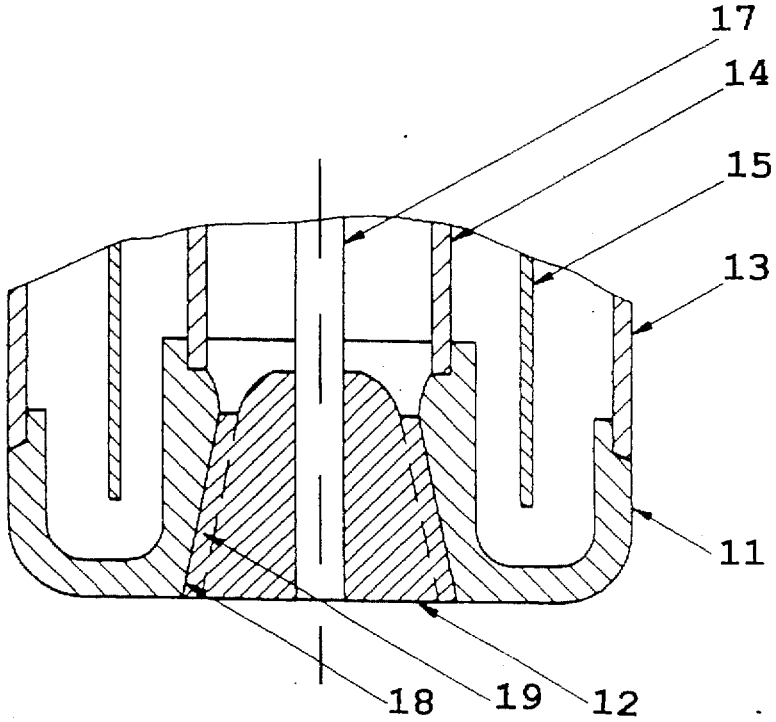

The nozzle shown in the FIGS. 1 and 2 comprises an outer body 11 and a central body 12 which form a slot 23 between them. The outer body 11 is arranged to be soldered to the outer and inner tubes 13, 14 of an oxygen lance. In the annular space between the tubes 13 and 14, there is an intermediate tube 15 around which cooling water is circulated in a conventional manner. The central body 12 is fixed to a rod 17 by being screwed to it or soldered to it. The rod 17 extends through the lance.

The outer body 11 of the nozzle has a conical opening 18 and the central body 12 of the nozzle is substantially conical and it has six axial lands or keys 19, with parallel sides, that fit the conical opening 18. The nozzle is formed as a supersonic nozzle. The keys 19 divide the slot 23 into six parts, which results in holes in the annular jet at the exit of the nozzle. Ambient gas flows in through these holes and fills out the subpressure that otherwise would occur close to the central body 12 and prevent the jet from diverging conically. These holes in the jet are filled and the jet is completely annular when it hits the melt.

Figure 3:
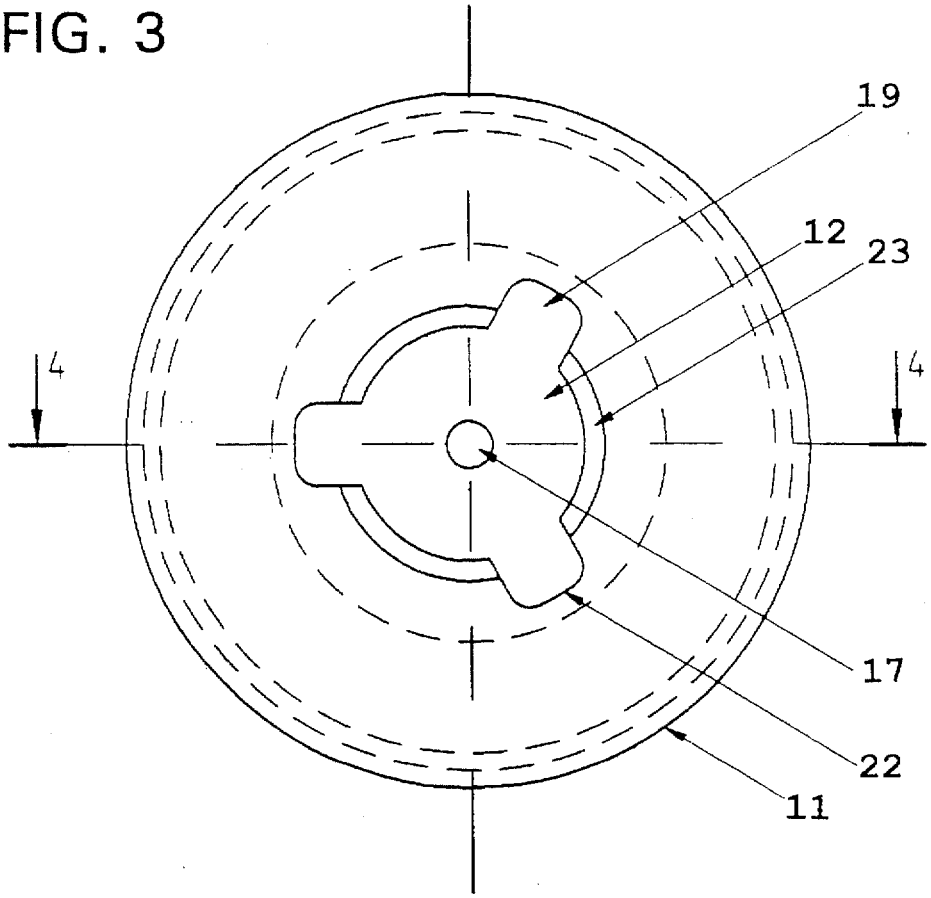
FIG. 3 is an end view of another nozzle and FIG. 4 is a section taken along the line 4—4 in FIG. 3.
Figure 4:
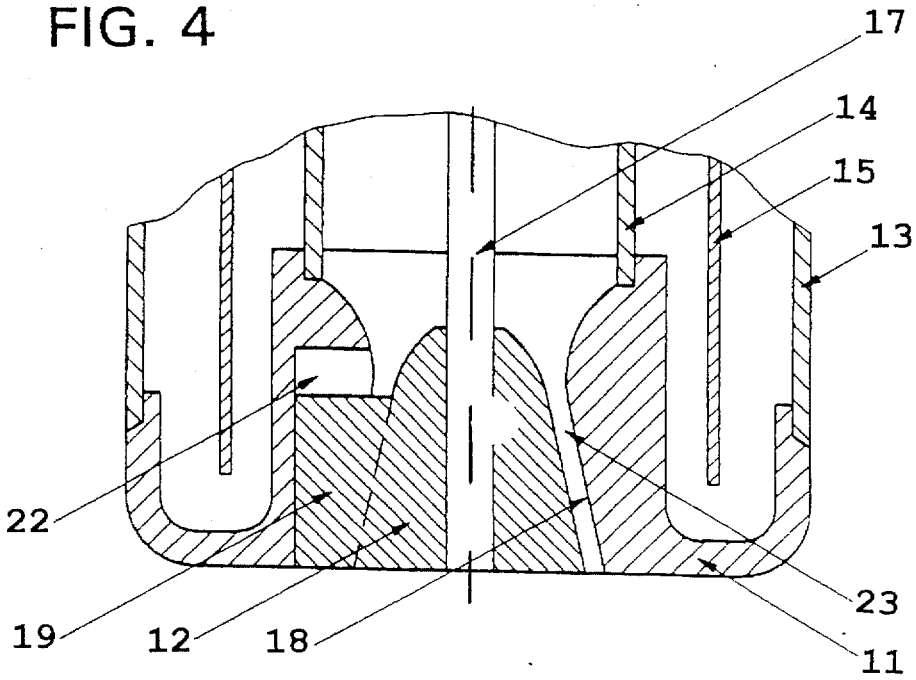

In FIGS. 3 and 4, an alternative embodiment is shown in which the nozzle is adjustable. The same reference numerals are used as in FIGS. 1 and 2 for corresponding details. The outer body 11 of the nozzle has three grooves 22 in its conical surface 18 and the central body 12 has three axial lands or keys 19 that fit in the grooves 22. The grooves 22 permit axial adjustment of the central body 12 by means of the rod 17 so that the width of the slot 23 between the outer and inner bodies 11, 12 can be varied. The slot 23 is thus divided into three parts. The flow regulation can suitably by carried out with a flow regulator in the conduit that leads to the nozzle and the pressure in the conduit can be adjusted by adjustment of the slot width for control of the jet velocity. As a result, the flow regulation will be independent of the axial thermal expansion of the lance and its rod 17. The relation between the flow rate and the pressure of the oxygen blast can thus be varied during the refining process, and the wide target area will be maintained. The grooves 22 can alternatively be in the central body 12 and the keys 19 on the outer body 11.

Figure 5:
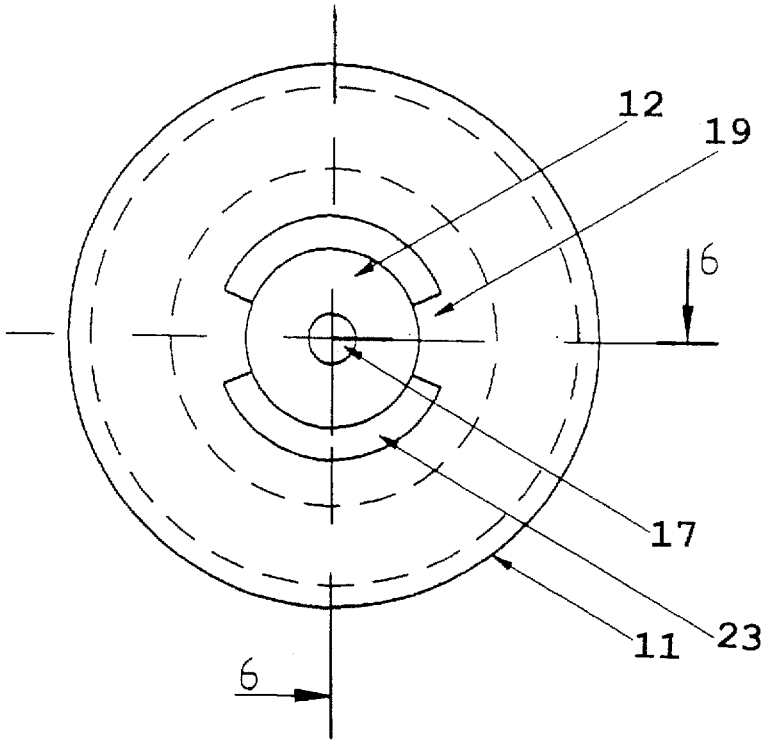
FIG. 5 is an end view of still another nozzle and FIG. 6 is a section taken along the line 6—6 in FIG. 5.
Figure 6:
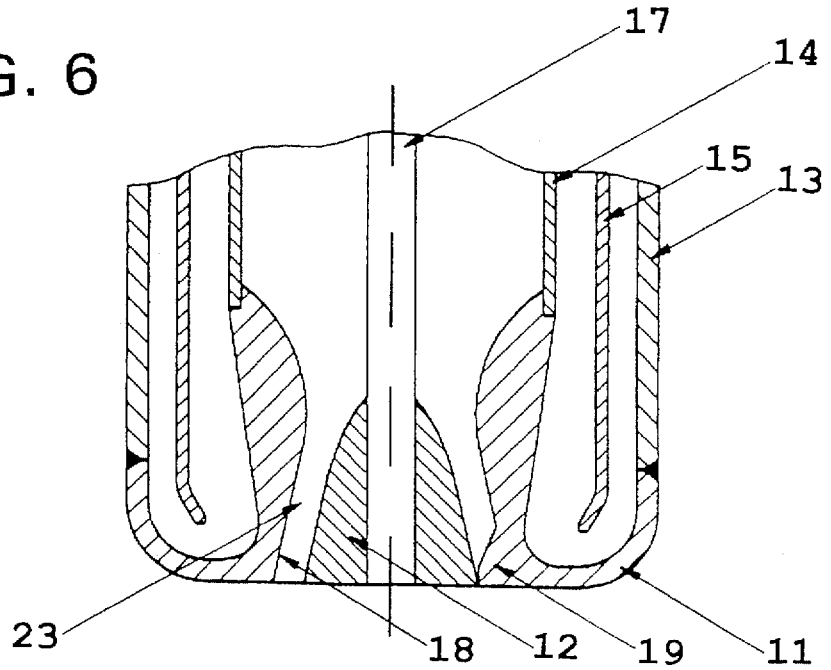

In FIGS. 5 and 6 another alternative embodiment is shown. Its central body 12 has no lands. Instead, its outer body 11 has two lands or bulbs 19 that block only the exit part of the slot 23. Thus, the slot 23 is divided into two parts with intermediate blockings 19. This nozzle will give a wide annular hot spot on the melt as do the previous embodiments. However, when the central body 12 is displaced inwardly by means of the rod 17, there will be no disruptions in the annular slot 23 and thus, no disruptions in the annular flow exiting the nozzle. As a result, there will be a subpressure in the center of the annular jet and the jet will contract and give a small hot spot on the melt. This nozzle makes it possible to impinge on the metal bath with a wide annular low velocity jet and with a narrow high velocity jet during various phases of the same blowing operation.

Figure 8:
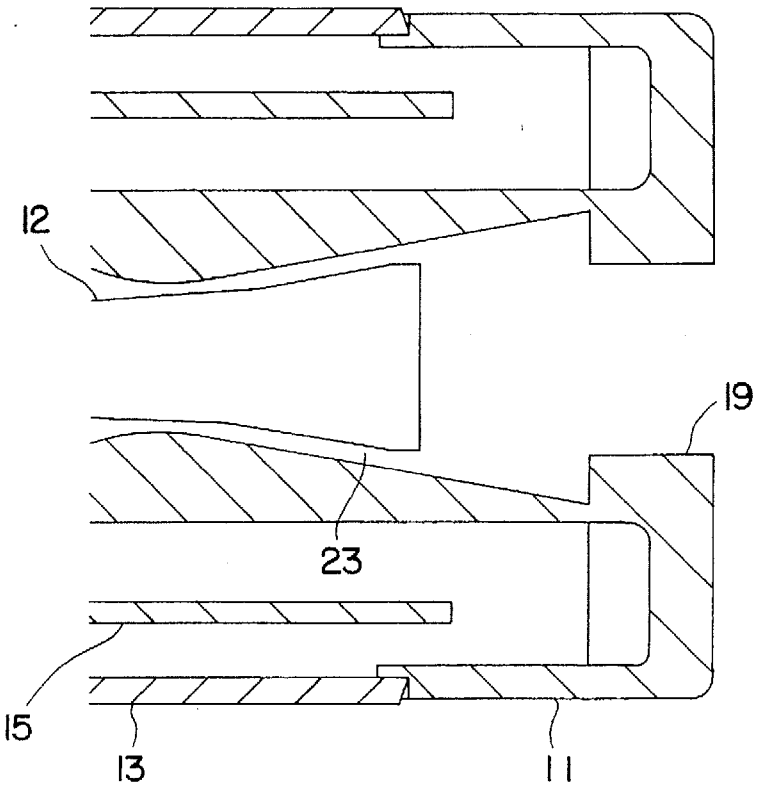
FIG. 8 is a sectional view of the nozzle shown in FIG. 7, but with the central body of the nozzle in a different operating position.
Figure 7:
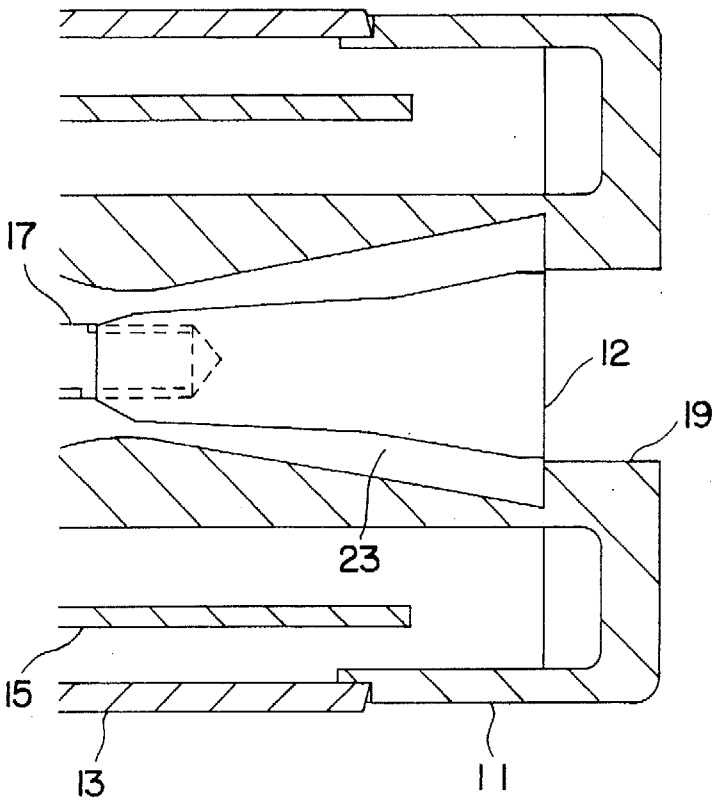
FIG. 7 is a sectional view of yet another nozzle.

In FIGS. 7 and 8, yet another alternative embodiment is shown. Its central body 12 has no lands. Instead, its outer body 11 has radial projections 19 that block only the exit part of the slot 23. The slot 23 could thus be divided into two parts, with two such radial projections 19 being formed on the outer body 11. An end view of the embodiment shown in FIG. 7 could therefore be similar to that shown in FIG. 5, with the two intermediate blockings 19 of FIG. 5 corresponding to the radial projections 19 of FIG. 7.

As shown in FIG. 7, the central body 12 is attached to rod 17 via a threaded connection. The threaded connection allows the central body 12 to move longitudinally with the rod 17, thereby allowing control of the longitudinal positioning of the central body 12 with respect to the slot 23. The central body 12 as shown in FIG. 7 can correspond to an operating position producing an annual diverging jet. The central body 12 can be moved longitudinally by rod 17 to the position shown in FIG. 8. The central body 12 is withdrawn away from the exit of the nozzle, to a position that can correspond to an operating position producing a tight jet. This nozzle makes it possible to impinge on the metal bath with a wide annular jet and with a tight jet during various phases of the same blowing operation.

Figure 10:
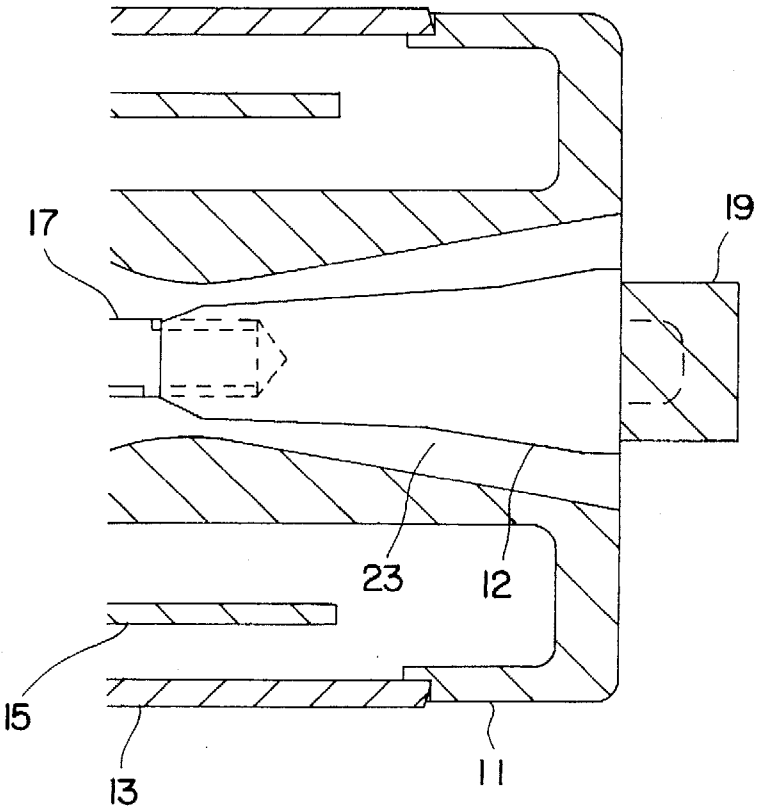
FIG. 10 is a section taken along the line 10—10 in FIG. 9.
Figure 9:
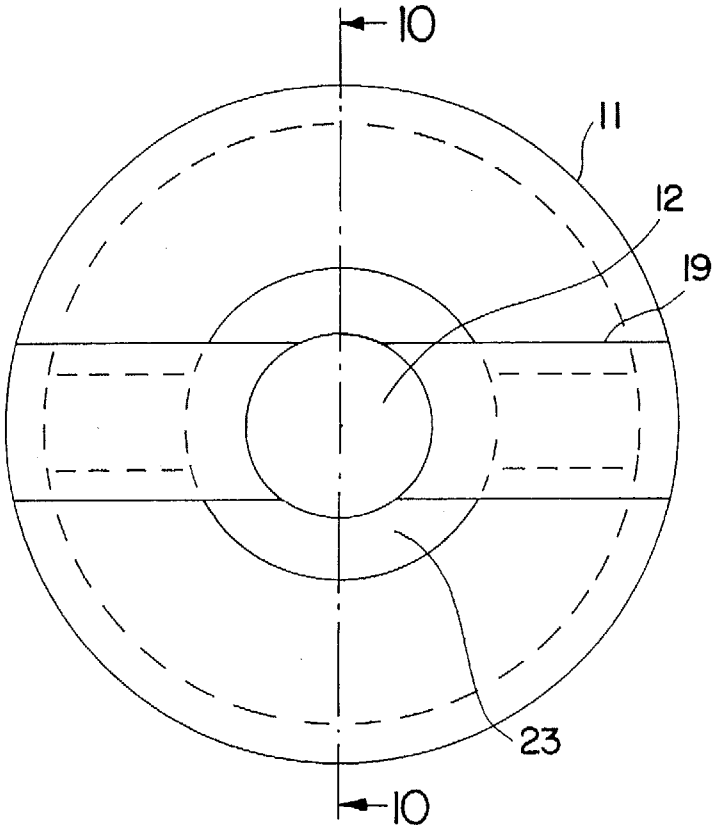
FIG. 9 is an end view of an additional nozzle.

In FIGS. 9 and 10, still another alternative embodiment is shown. Its central body 12 has no lands. Instead, the exit end of the central body 12 is attached to a bar 19. The bar 19 extends across the slot 23, thereby dividing slot 23 into two parts, which results in the holes in the annular jet at the exit of the nozzle.

As an alternative to forming holes in the jet for counteracting a subpressure against the central body 12, gas can be supplied from the end of the lance through the rod 17 and the central body 12. The gas flow supplied in this way must probably be of the same order of magnitude as the flow through the nozzle. and the illustrated embodiment is preferable. A combination of holes in the jet and a gas supply through the rod 17 and the central body 12 is also possible, and may be advantageous. A tube-formed rod 17 can be used also for supplying pulverulent material suspended in a gas or liquid.

Figure 11:
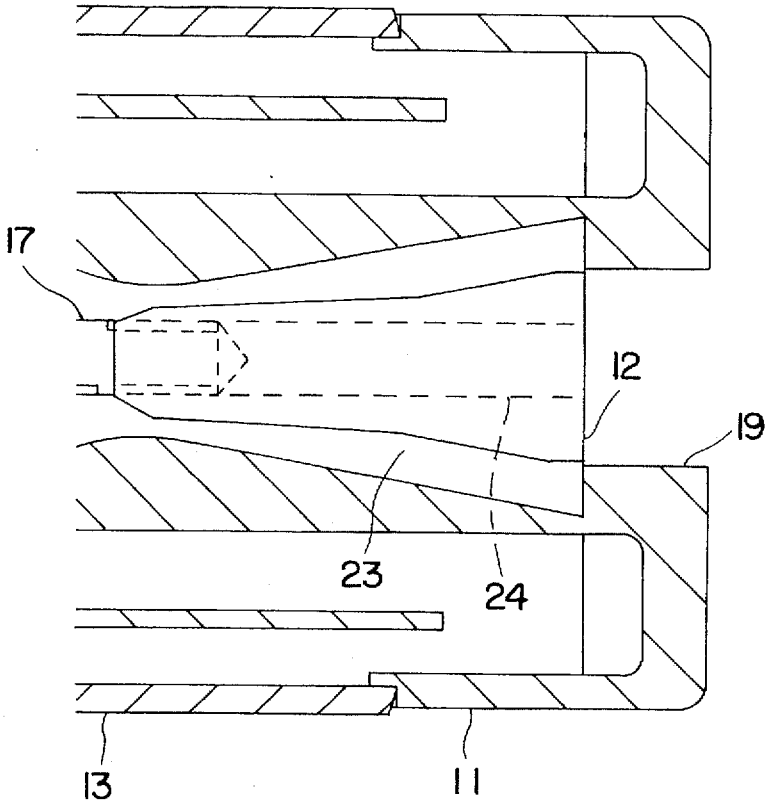
FIG. 11 is a section view of yet an additional nozzle.

In FIG. 11, a yet additional alternative embodiment is shown. Rod 17 is realized as a hollowed tube. The central body 12 also contains a hollow passage 24 which can communicate with the hollowed tube, rod 17. Via rod 17 and the hollow passage 24, gas or other materials can be introduced as discussed above. The nozzles and the lance described can be used in BOS (Basic Oxygen Steelmaking) and in other metallurgical processes in which a top blowing lance is used.

Examples of blowing nozzles which could possibly be adapted for use in the present invention, along with additional components generally associated with blowing nozzles which might be interchangeable with, or adaptable as, components of the embodiments as described hereinabove, might be disclosed by the following U.S. Pat. Nos. 5,377,960; No. 5,303,901;No. 5,227,118; No. 4,993,691; No. 4,971,297; and No. 4,951,928.

Additional examples of blowing nozzles which could possibly be adapted for use in the present invention, along with additional components generally associated with blowing nozzles which might be interchangeable with, or adaptable as, components of the embodiments as described hereinabove, might be disclosed by the following non U.S. Patents: FR 1442939; SE 213010; DE 2321853; and WO 9218819.

Examples of refining methods which could possibly be adapted to use the present invention might be disclosed by the following U.S. Pat. Nos. 5,462,579; 5,444,733; 5,413,623; 4,936,908; and U.S. Pat. No. 4,891,064.

The components disclosed in the various publications, disclosed or incorporated by reference herein, may be used in the embodiments of the present invention, as well as equivalents thereof.

The appended drawings in their entirety, including all dimensions, proportions, and/or shapes in at least one embodiment of the invention are accurate and to scale and are hereby included by reference into this specification.

All, or substantially all, of the components and methods of the various embodiments may be used with at least one embodiment or all embodiments, if more than one embodiment is described herein.

All of the patents, patent applications, and publications recited herein, and in the Declaration attached hereto, are hereby incorporated by reference as if set forth in their entirety herein.

The corresponding foreign and international patent publication applications, namely, Swedish Patent Application No. 9304369-3, filed on Dec. 30, 1993, and International Patent Application No. PCT/SE94/01260, filed on Dec. 28, 1994, having inventors Dan Bergman and Takeo Inomoto, as well as their published equivalents, and other equivalents or corresponding applications, if any, in corresponding cases in Sweden and elsewhere, and the references cited in any of the documents cited therein, are hereby incorporated by reference as if set forth in their entirety herein.

The details in the patents, patent applications, and publications may be considered incorporable, at Applicants' option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function, and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A supersonic annular nozzle for an oxygen lance for metallurgical use, said nozzle comprising:

an annular slot;

said annular slot being configured to form an annular jet of gas;

the formed annular jet having an interior portion and an exterior portion;

the exterior portion of the formed annular jet surrounding the interior portion of the formed annular jet;

the formed annular jet being surrounded by an ambient gas;

an arrangement to permit a gas supply to the interior portion of the formed annular jet; and said arrangement to permit a gas supply being disposed to block at least one part of said slot to permit the ambient gas to flow to the interior portion of the formed annular jet in order to counteract a subpressure in the interior portion of the formed annular jet.

2. A nozzle according to claim 1, wherein the nozzle comprises an outer annular body and a central substantially conical body which form together the annular slot of the nozzle, and keys and grooves in said bodies form said arrangement to permit a gas supply to the interior portion of the formed jet of gas, said central body being axially displaceable so as to permit for a variable slot width, while said keys are still blocking said at least one part of said slot.

3. A supersonic annular nozzle for an oxygen lance for metallurgical use comprising an outer annular body and a central body which form together the annular slot of the nozzle, wherein said central body is displaceable with respect to said annular body between a first position in which the slot is divided into separate parts so that the exiting annular jet will be divided into separate parts and a second position in which the entire annular slot is open so that the exiting annular jet will be without disruptions.

4. A nozzle according to claim 3, wherein said central body is substantially conical and axially displaceable between its two positions and one of said bodies has bulbs at the exit end of said slot, said bulbs blocking said slot when the central body is in its first position but not when it is in its second position.

5. A method of blowing hot metal with an oxygen lance having an annular nozzle, said method comprising the steps of:

forming an annular jet, the annular jet exiting said nozzle;

supplying a gas to the interior of the formed annular jet in order to counteract a subpressure in the interior of the formed annular jet; and said step of supplying a gas to the interior of the formed annular jet comprises the step of blocking parts of the annular gas flow exiting the nozzle in order to form holes in the annular jet through which holes ambient atmosphere can be sucked in.

* * * * *